US006190288B1

(12) United States Patent
Fisher

(10) Patent No.: US 6,190,288 B1
(45) Date of Patent: Feb. 20, 2001

(54) SLIM NECK EXERCISE COLLAR

(76) Inventor: Earlene Fisher, Box 2047, Andrews, TX (US) 79714

( * ) Notice: Under 35 U.S.C. 154(b), the term of this patent shall be extended for 0 days.

(21) Appl. No.: 09/229,493

(22) Filed: Jan. 11, 1999

Related U.S. Application Data

(60) Provisional application No. 60/071,621, filed on Jan. 16, 1998.

(51) Int. Cl.[7] ..... A63B 23/025

(52) U.S. Cl. ..... 482/10; 2/300

(58) Field of Search ..... 482/10, 124, 126, 482/148, 140, 907; 601/39; 602/18; 2/468, 300, 311, 314, 322; 607/109, 108

(56) References Cited

U.S. PATENT DOCUMENTS

| | | | | |
|---|---|---|---|---|
| 2,688,324 | | 10/1954 | McCarthy . | |
| 3,008,464 | * | 11/1961 | Atkins | 601/39 |
| 3,245,404 | | 4/1966 | Ritzcovan . | |
| 3,320,950 | * | 5/1967 | McElvenny | 602/18 |
| 3,457,914 | | 7/1969 | Donaldson . | |
| 3,530,853 | * | 9/1970 | Bond | 602/18 |
| 3,725,956 | * | 4/1973 | Reisen | 2/171 |
| 3,727,609 | | 4/1973 | Hale . | |
| 3,886,935 | * | 6/1975 | Sprague | 601/39 |
| 3,921,626 | * | 11/1975 | Neel | 602/18 |
| 4,301,548 | * | 11/1981 | Blake | 2/91 |
| 4,572,167 | | 2/1986 | Brunswick . | |
| 4,593,417 | * | 6/1986 | Brown, Jr. et al. | 2/172 |
| 4,627,109 | | 12/1986 | Carabelli . | |
| 4,699,375 | * | 10/1987 | Appelbaum et al. | 482/81 |
| 4,891,501 | * | 1/1990 | Lipton | 601/110 |
| 4,922,929 | * | 5/1990 | DeJournett | 128/892 |
| 5,295,949 | * | 3/1994 | Hathaway | 482/10 |
| 5,419,757 | * | 5/1995 | Daneshvar | 602/60 |
| 5,498,218 | * | 3/1996 | Proctor et al. | 482/10 |
| 5,549,528 | * | 8/1996 | Bryant | 482/81 |
| 5,681,248 | * | 10/1997 | Vani | 482/10 |
| 5,711,747 | * | 1/1998 | Steinback | 482/124 |

* cited by examiner

*Primary Examiner*—Justine R. Yu
(74) *Attorney, Agent, or Firm*—Wendell Coffee; Mark Scott

(57) ABSTRACT

A collar of lambswool in a silk sleeve is wrapped around the neck to promote sweating and therefore a reduction of the size of the neck.

2 Claims, 3 Drawing Sheets

SLIM NECK EXERCISE COLLAR

CROSS REFERENCE TO RELATED APPLICATION

Applicant filed a Provisional Application on this subject matter on Jan. 16, 1998, Ser. No. 60/071,621. Specific reference is made to that document.

BACKGROUND OF THE INVENTION (1) Field of the Invention

This invention relates to reducing the size of the neck. Craft persons have ordinary skill in this art.

(2) Description of the Related Art

There are many attempts in the related art to reduce the apparent size of the human neck. Most of these attempts are based on pulling the skin of the neck back in order to give the appearance of a smaller neck. None of these attempts however actually reduce the size of the neck.

Indicative of the attempts to reduce the apparent size of the neck is DONALDSON U.S. Pat. No. 3,457,914. DONALDSON describes his invention as a "neck tensioning device". DONALDSON'S device, quite simply, is a device that wraps around the neck and is tensioned thereon. The tensioning of the device pulls the loose skin of the neck back to give the appearance of a smaller neck.

SUMMARY OF THE INVENTION (1) Progressive Contribution to the Art

This invention is a device that wraps around a human neck. This device is designed to hold heat and thereby increase the temperature of the neck to promote sweating. This sweating then reduces the overall size of the neck.

(2) Objects of this Invention

An object of this invention is to reduce the overall size of a human neck.

Further objects of this invention are to reduce the size of the neck while being comfortable, other than elevated temperature, to the wearer.

Other objects are to achieve the above with a method that is rapid, versatile, ecologically compatible, energy conserving, efficient, and inexpensive, and does not require highly skilled people to use and maintain.

Further objects are to achieve the above with devices that are sturdy, compact, durable, lightweight, simple, safe, efficient, versatile, ecologically compatible, energy conserving, and reliable, yet inexpensive and easy to manufacture, use and maintain.

Further objects are to achieve the above with a product that is easy to store, has a long storage life, is safe, versatile, efficient, stable and reliable, yet is inexpensive and easy to manufacture and use.

The specific nature of the invention, as well as other objects, uses, and advantages thereof, will clearly appear from the following description and from the accompanying drawings, the different views of which are not necessarily scale drawings.

CATALOGUE OF ELEMENTS

Figure 1:
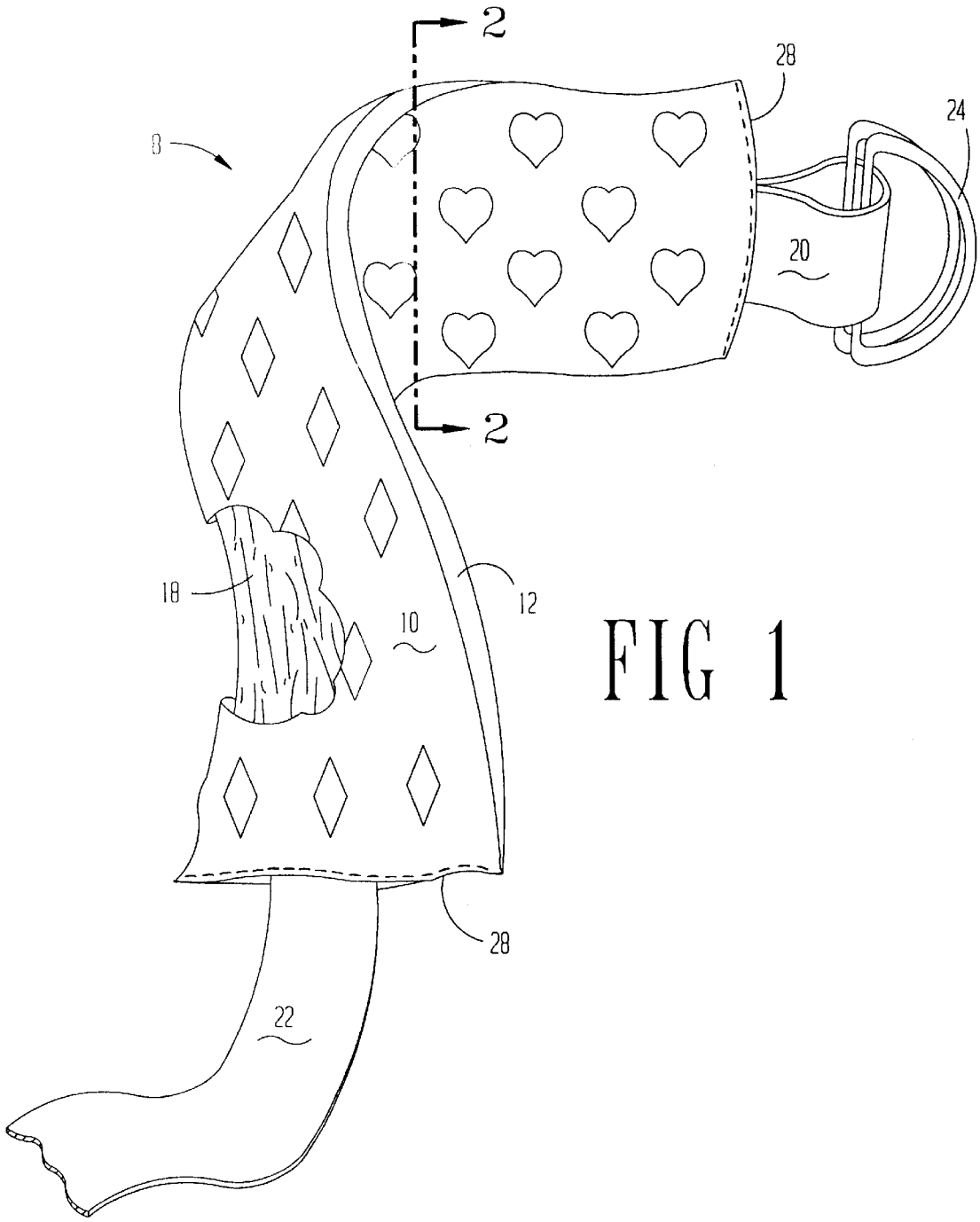
FIG. 1 Perspective cutaway of the invention.
Figure 2:
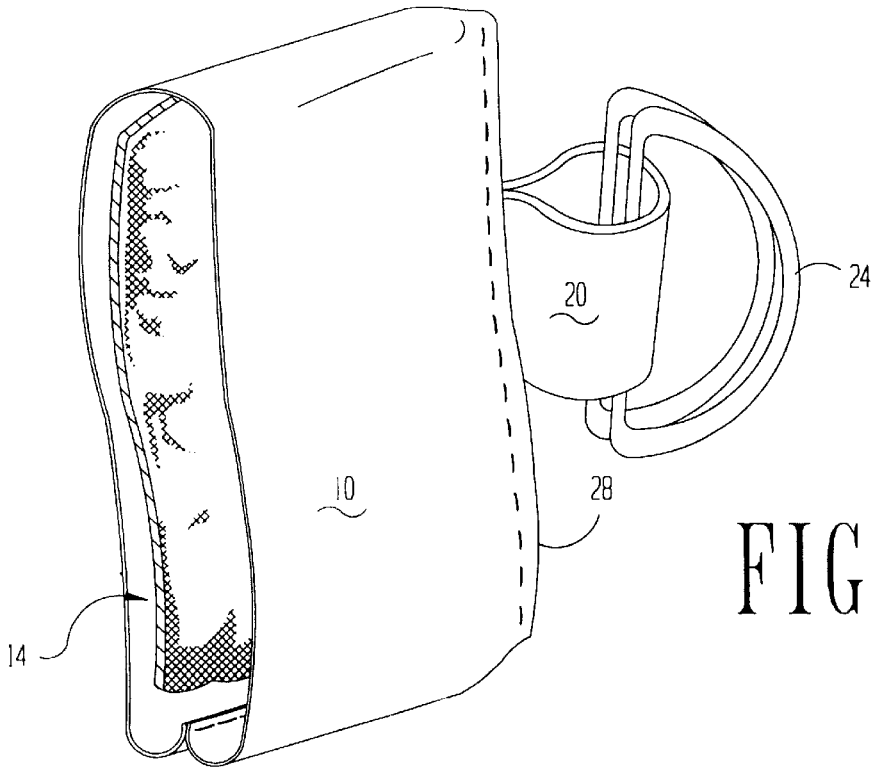
FIG. 2 Cross sectional view of the invention substantially along line 2—2.
Figure 3:
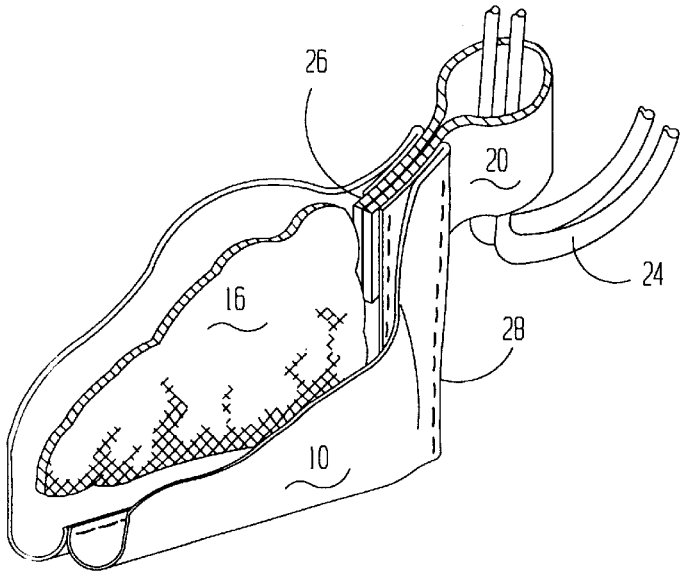
FIG. 3 A partial cross sectional view of the invention.
Figure 4:
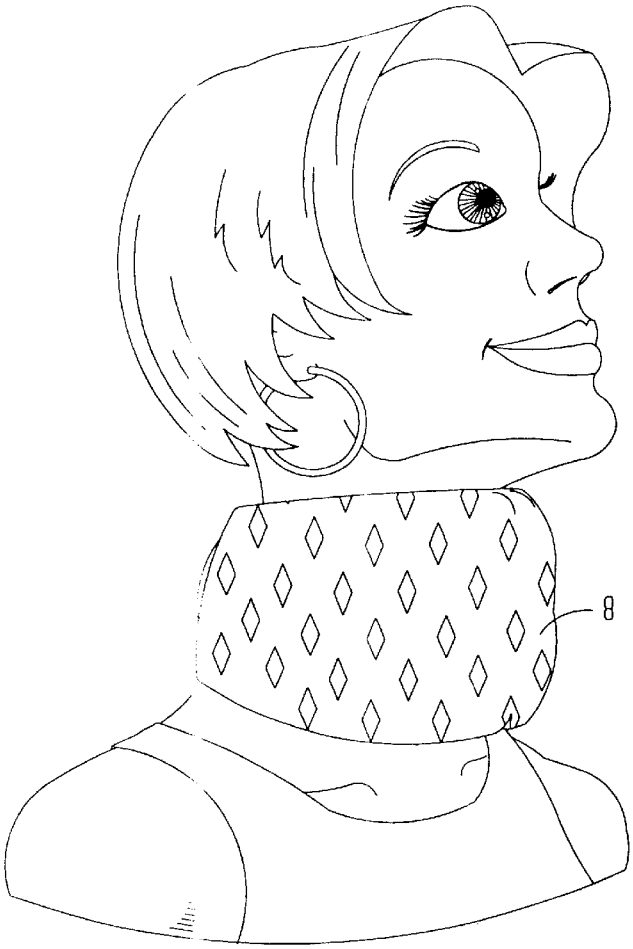
FIG. 4 Perspective side view of the invention on a human neck.
Figure 5:
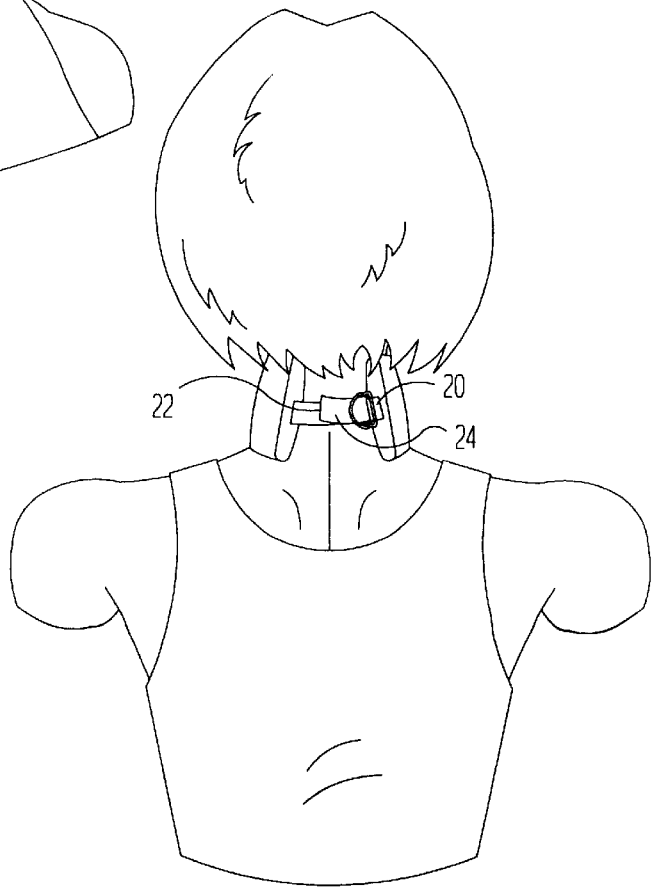
FIG. 5 Perspective back view of the invention on a human neck.

As an aid to correlating the terms of the claims to the exemplary drawing(s), the following catalog of elements and steps is provided:

8 collar
10 silk material
12 long edges
14 lamb skin
16 leather
18 fleece
20 1" portion
22 14" portion
24 D rings
26 closed ends
28 tube end

DESCRIPTION OF THE PREFERRED EMBODIMENTS(S)

In operation collar 8 is placed around the neck. The collar, by virtue of its insulating properties, and in combination with elevated body temperature caused by at least light exercise, causes heat buildup around the neck. This heat buildup triggers the sweat glands in the neck to begin secreting perspiration, i.e. water. Once exercise is complete, the perspiration secreted in and around the neck due to the elevated temperature therein reduces the mass of the neck. This reduction in the mass of the neck, in terms of water loss, reduces the size of the neck.

Construction of the preferred embodiment starts with a piece of silk material 10, or a piece of silk/rayon blend, in a rectangular shape approximately 10" tall and 16" wide. Silk of course being the fiber produced by silkworms to form their cocoons. Rayon is a synthetically produced fiber created by pressing either cellulose acetate, or other cellulose solution through very small holes. The fibers produced thereby are woven to form fabrics. Silk, or a silk/rayon blend, is used because of its pleasant feel and low heat conductivity. In other words, the silk fabric tends to act as an insulator to hold heat. The rectangular piece of fabric is formed to a tube, or sleeve, by folding it along its width and sewing together the two long edges 12.

To create a more aesthetically pleasing embodiment of the invention, the sleeve or tube sewing should be completed by turning the tube inside out and sewing along its width. Once the sewing is complete, the tube is turned right side out. This sewing operation, which is well within the means of one of ordinary skill in the art, places the distal ends of the fabric left by the sewing within the tube.

Next a piece of 100% natural lambswool 14 approximately 15" long and 3¾" wide is placed inside the tube or sleeve. Lamb skin, in the context of this invention, comprises the hide on leather 16 of the lamb with the wool or fleece 18 still attached thereon. Correct placement of the invention around the neck involves placing the fleece side of the lamb skin toward the neck and the leather side away from the neck. It will be understood that although the skin of the neck does not contact the lamb skin 14, the use thereof gives a soft property to the exercise collar as well as providing additional insulating properties.

From an elastic strap approximately 15" long and 1" wide, a 1" portion 20 is cut therefrom. This leaves an approximately 14" portion 22 of elastic strap. The 1" elastic strap 20 is fed through the center of two "D" rings 24. "D" rings, as the name implies, are pieces of metal formed into the shape of a "D". The closed ends 26 of the 1" portion 20 are then sewn into one tube end 28 of the collar.

During construction then, the tube has two open ends. In one of those ends the 1" elastic strap 20, held together at its closed ends 26 holding the "D" rings 24, and the tube itself is sewn shut on that end with a 1" elastic strap portion 20 centered thereon. The remaining 14" elastic strap portion 22 is likewise sewn into the remaining tube end 28 of the tube in a similar fashion. By sewing these elastic straps in place the tube is thereby closed. The approximately 14" elastic strap portion 22 in combination with the two "D" rings 24 held in place by the 1" elastic strap portion 20 form a means for holding the exercise collar around the human neck.

Two "D" rings, in conjunction with the strap material, form a means for fastening or holding the strap in a particular position, i.e. a fastener. This fastening is accomplished by static friction of the strap material against itself. In operation, the strap material is fed through the center of the two "D" rings. The strap is then fed back through the center of only one of the "D" ring thereby overlaying itself. As tensioning force are applied to the strap material and "D" rings respectively, the static friction of the strap material against itself, as looped through the "D" rings, holds the strap in place.

This description has referenced the use of "D" rings as a portion of the fastening mechanism. However, this invention is not limited to the use of "D" rings as the fastening mechanism. One with ordinary skill in this art would easily see that square or rectangular rings would work equally well as most likely would circular rings used in the same manner. Beyond the use of these static friction type fasteners, one with ordinary skill in the art could find many mechanisms to accomplish the task of holding the exercise collar on the neck. E.g., a single ring and a Velcro strap that feeds through the ring and attaches back upon itself, a Velcro strap that wraps around the neck and fastens back against the main body of the exercise collar, or a plastic shear strength buckle like one might find on a life preserver.

In like manner, the drawings show different patterns in the material covering the lambs fleece to indicate an inside and an outside portion thereof. One with ordinary skill in this art could very easily find a different set of patterns to indicate the inside and outside portion of the lambs fleece. Also, it is possible, and still within the contemplation of this invention, that a single pattern piece of material could be used to create the tube structure. If such was done other means of indicating the fleece side of the lamb fleece could be used or there could be no indication at all. However, the preferred method of use of the exercise collar is to place the fleece portion against the neck of a human. Determining which portion of the exercise collar to place against the neck in the instance where the pattern of the tube material is uniform, simply feeling for the soft side would suffice.

The invention has been described as having a substantially rectangular shape to be placed around the neck; however, one with ordinary skill in this art would see that different shaped exercise collars would still be operable. The rectangular shape exercise collar is the preferred embodiment in part based on the ease of construction.

By the above specifications and drawings, one with ordinary skill in the art will understand how to make and use the invention as described. At this time the description above includes the best mode known to the inventor of carrying out his invention.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to point out the advantages and the progressive contribution to the art and to enable one skilled in the art to make and use the invention. The limits of the invention and the bounds of the patent protection are measured by and defined in the following claims.

I claim as my invention:

1. The structure of an exercise collar comprising:

a) lambskin having a leather side and a fleece side approximately three and three quarter inches wide and fifteen inches long, b) a cloth material covering the lambskin, c) the cloth material being approximately ten inches wide and sixteen inches long formed into a tube having two ends, d) said lambskin within said tube and the ends of said tube sewn closed, e) said cloth material being at least partially silk, f) said cloth material having a fleece side next to the fleece side of the lambskin and a fleece side pattern different from a leather side pattern on the cloth next to the leather side of the lambskin, g) said lambskin and cloth material shaped to cover a portion of a human's neck, h) a fastener adapted to hold the exercise collar against the human's neck, said fastener having:

i) two fastener rings, j) a short portion of strap material looped around the fastening rings and sewn in a first end of tube, and k) a long portion of strap material having one end sewn in a second end of the tube, l) whereby the long portion of strap forms the fastener when threaded through said fastener ring, m) the long portion of strap material which is sewn to the tube being elastic strap material, and n) the long portion of strap material being approximately one inch wide.

2. The structure as defined in claim 1 further comprising:

l) said cloth material being silk and rayon blend.

* * * * *